US005344373A

United States Patent [19]

Greene

[11] Patent Number: 5,344,373

[45] Date of Patent: Sep. 6, 1994

[54] STATIONARY SWIMMING APPARATUS

[76] Inventor: Allison K. Greene, 10947 Bloomfield, #118, Studio City, Calif. 91602

[21] Appl. No.: 910,668

[22] Filed: Jul. 8, 1992

[51] Int. Cl.[5] ..... A63B 31/00

[52] U.S. Cl. ..... 482/55; 482/121; 482/124

[58] Field of Search ..... 128/DIG. 15; 482/124, 482/55

[56] References Cited

U.S. PATENT DOCUMENTS

| | | | |
|---|---|---|---|
| 554,636 | 2/1896 | Hulsmann | 482/124 |
| 4,247,096 | 1/1981 | Schmitt | 482/55 |
| 4,699,132 | 10/1987 | Carville | 128/DIG. 15 |
| 4,815,731 | 3/1989 | Suarez et al. | 482/124 |
| 4,948,117 | 8/1990 | Burke | 272/71 |
| 5,069,457 | 12/1991 | Korzenowski | 128/D15 |

*Primary Examiner*—Richard J. Apley
*Assistant Examiner*—Jerome Donnelly

[57] ABSTRACT

A device for pool use that holds a swimmer stationary. A base strap attaches to a stationary poolside object. Two ankle straps are directly connected to said base strap by two elastic cords, respectively. The ankle straps are attached to a swimmer's ankles. The swimmer can then engage in continuous swimming exercise in a small pool as the stationary swimming apparatus holds the swimmer stationary with respect to the poolside object.

4 Claims, 2 Drawing Sheets

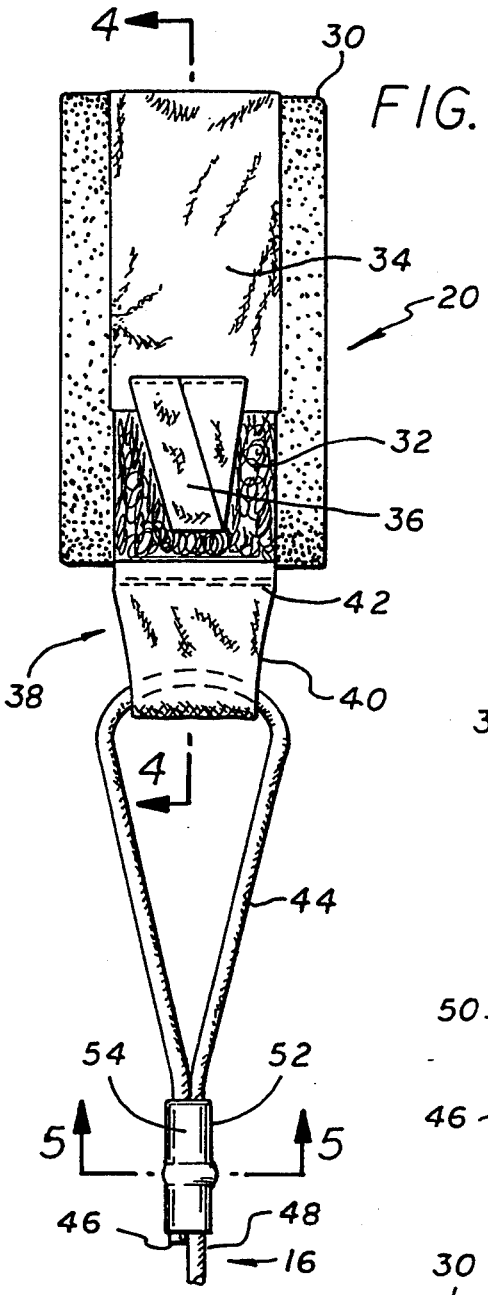
FIG. 3
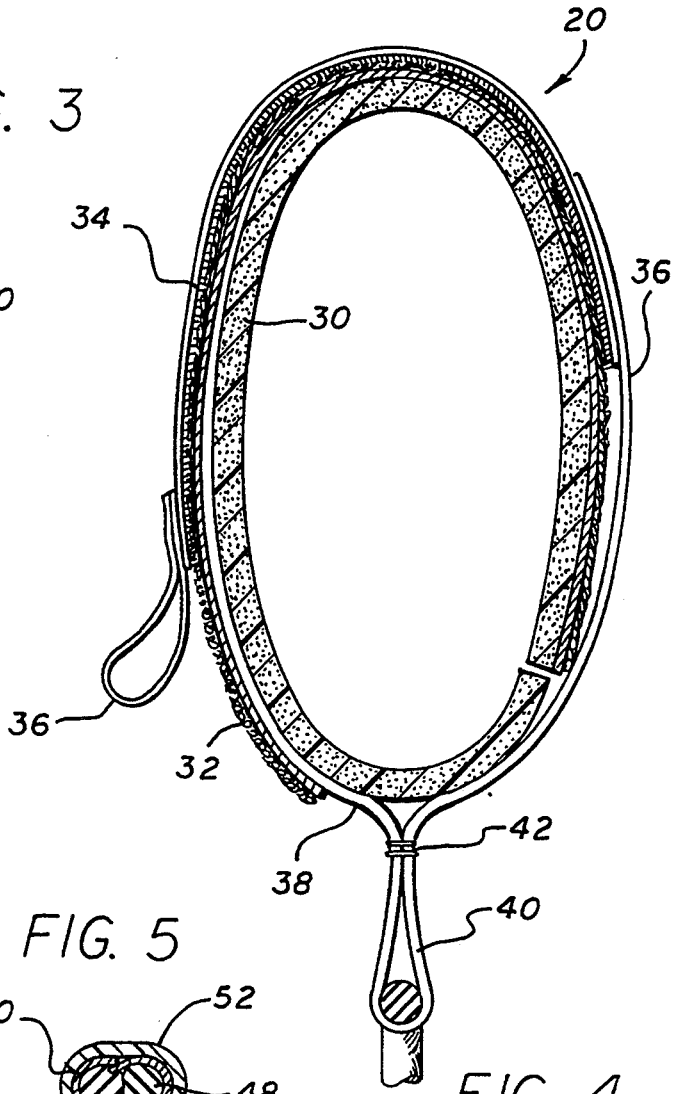
FIG. 4
FIG. 5
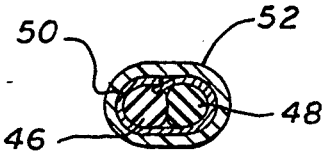
FIG. 6
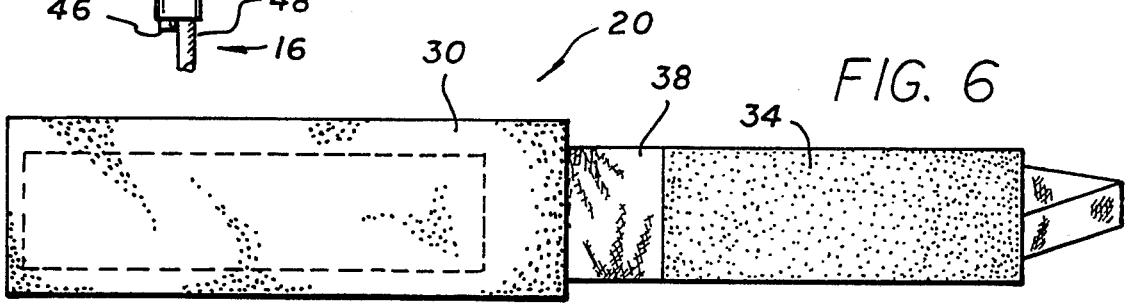
FIG. 7
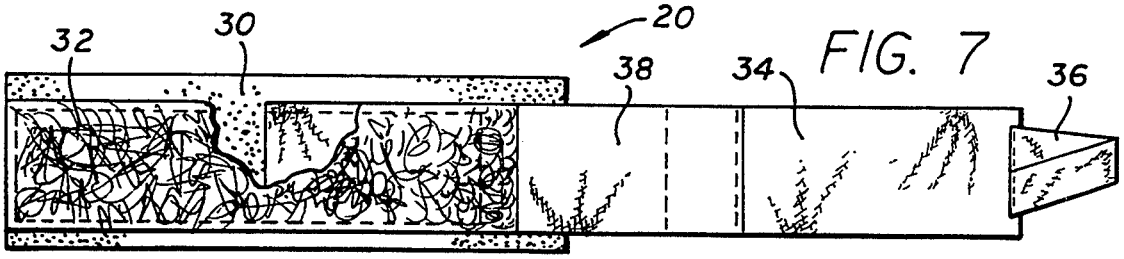

STATIONARY SWIMMING APPARATUS

BACKGROUND OF THE INVENTION

1. Field of the Invention

This invention relates to swimming devices and more particularly to a swimming device that allows the swimmer to swim in the water while preventing the swimmer from traveling through the water.

2. Description of the Related Art

Numerous devices have been invented and produced for swimming and related recreational water activities. Rafts, swim masks, and various other toys are all known in the art.

Swimming is considered to be one of the best exercises available, better even than that of running or jogging, as swimming is a low impact sport. Swimming exercises both sets of the swimmer's extremities and provides the highly aerobic activity that running does without the destructive impacts that are continually placed upon the joints of a runner.

Recently, and with the increased interest in better health through physical fitness, devices have appeared on the market that allow a person to exercise in the water to take advantage of the drag inherently present with any motion through the water. One such device is a set of water dumbbells that substitutes the drag of the water for the force previously provided by weights. A second device is a flotation device that wraps around a person's midsection to allow the person to float safely upright in the water while engaging in the same physical motion runners or joggers perform while running or jogging. For both devices, the drag of the water provides a resistive force that not shock or jar the person's body. Further, the drag of the water is continuous and so exercises any muscle or muscle group continually throughout the entire articulation of that muscle or muscle group.

Both of these devices provide exercise and develop the muscles of their users, but they do not provide the same rigorous exercise as does swimming. Consequently, while these devices have their place, they do not replace swimming as one of the most, if not the most, desirable exercises for improving health through physical activity.

While swimming is good exercise, not all people are able to engage in swimming activity. There are several possible reasons. A swimming pool or facility may not be available. A pool or facility may be available, but it may be too small for a swimmer to engage in the continuously repetitive swimming strokes that require a pool of some size. With a small pool, a swimmer may be able to cover the longest length of the pool in only a few strokes, forcing the swimmer to reverse direction several times a minute. Swimming under such circumstances in a small pool forces the swimmer to concentrate on his or her position in the pool rather than on the swimming strokes. Further, the enjoyable aspects of swimming derived from the ongoing rhythmic activity are completely disrupted by having to stop and turn every ten or twelve strokes. While a small pool is not preferable when swimming for exercise, such a pool might be readily available, especially to the many people living in apartment complexes that have a small pool available for the tenants. For some areas, above-ground pools are common and may be readily available.

Large swimming pools or facilities are expensive and are only infrequently constructed for private use, even by wealthy individuals. Such larger facilities also require major upkeep with its accompanying inconveniences. While a large swimming pool is probably the best place to engage in swimming, such facilities are not privately available to most people.

However, public swimming facilities on a large scale may be available to the public in general. In most metropolitan areas, public swimming facilities are provided that would allow a person to engage in swimming for exercise. While these public facilities do provide a place where people may swim for exercise, such facilities may be crowded. It is difficult to make the long pool-length courses desirable when swimming for exercise when the path is littered by other individuals having fun and otherwise using the public pool as is proper.

Swimming for exercise programs may be available at certain times of the day at certain swimming facilities. Organizations such as the YMCA, YWCA, or other similar organizations may have programs that allow a swimmer to use a pool for exercise swimming. Of course, it then becomes necessary for the swimmer to fit his or her schedule to one that is imposed by the program or organization. If the swimmer's schedule does not mesh with that of the program, it may not be possible for the swimmer to take advantage of the program.

For both the public swimming facility and a swimming facility provided by a non-public organization, some travel may be required of the swimmer in order to use the pool. Such travel can cramp an otherwise busy schedule and can reduce the amount of time available to engage in exercise swimming.

In order to engage in exercise swimming, it would be very helpful to combine the convenience of a small pool with the travel length of a big pool. One solution to this problem is to create a current of flowing water in a small pool that runs counter to the direction of the swimmer's travel. Such pools have been previously advertised in magazines. The installation of such a countercurrent pool, or the modification of an existing pool to perform as a counter-current pool, can only be made at a significant expense and subsequently requires significant upkeep that can be inconvenient.

U.S. Pat. No. 4,948,117 issued to Burke on Aug. 14, 1990 discloses a swim band that allows a swimmer to use almost any swimming pool to engage in continuous exercise swimming. By releasably attaching harnesses to the swimmer's legs and then by attaching the harnesses to the swim band, a swimmer is tethered in place so that he or she can swim without moving relative to the point of attachment. While the Burke device represents some improvement over the prior art, some drawbacks remain that detrimentally affect the use and manufacture of the Burke swim band.

The primary problem with the Burke swim band is the use of harnesses to attach the swim band to the swimmer's lower extremities. While providing an effective means of attachment to the swimmer, Burke's harnesses are not as effective as other configurations might be and hinder the swimmer's physical activity in the water.

As can be seen from the drawings in the Burke patent, the harness requires two points of attachment to the belt that wraps around the swimmer's lower extremity. Having two points of attachment at least doubles the potential interference the harness will have with the swimmer's foot. It is much more advantageous to have but a single point of attachment between the swimmer's foot and a device holding the swimmer stationary in the water. With but a single point of attachment, the cord holding the swimmer in place is more easily avoided and less effort must be made by the swimmer to avoid the attachment and the cord. Even greater advantages would be presented to the swimmer if the single point of attachment were adjustable so that for whatever stroke the swimmer engages in, the best and least entangling position is attained for the point of attachment.

In attaching the belts to the swimmer's lower extremities, Burke does not provide easy means by which the swimmer may disengage from the swim band. It may become necessary, especially in the case of an emergency, for the swimmer to disengage from the Burke swim band. The belts in Burke do not provide easy means for disengagement and those belts may be difficult to pull apart or otherwise uncouple. Further, the harnesses in Burke are not easily disengaged from the swim band as the spring-biased keeper must be found not only for one, but for both harnesses. Under the stress of an urgent situation it may be difficult to disengage the harnesses from the swim band and/or the belts from the swimmer.

The Burke harness also requires directional biasing of the flexible fabric strap (reference number 34). The directional biasing of the flexible fabric strap may work adequately for freestyle or Australian crawl swimming. However, such directional biasing of a loop would not work adequately for other swimming strokes such as the backstroke, the butterfly stroke, or the breast stroke. These swimming strokes call for different motions of the swimmer's feet than is performed for the Australian crawl. For these other swimming strokes with their different foot motions, the directionally biased loop provides many more opportunities for the swimmer's foot to become entangled with the harness. Further, the directionally biased loop can only be attached to the foot in one of two ways in order for the swimmer's foot to fit within the loop. This lack of adjustability of Burke's harness makes entanglement of the swimmer's foot by the harness more probable.

Burke's detachable harnesses may also encumber the swimmer's feet at the point the swim band attaches to the harness. Additional and potentially encumbering structures are present in the Burke swim band in order to allow the harnesses to detach from the swim band. Whatever form taken by these means of detachment, they can only detract from the integrity and effective use of the swim band. Further, allowing the harnesses to detach from the swim band requires greater effort and expense in order to make and manufacture a Burke swim band. Also, if one of the detachable harnesses were to be misplaced, the Burke swim band would be rendered useless as the swimmer would not be able to enjoy a balance of forces used to restrain the swimmer and maintain him or her in place. If only one harness attached one leg of the swimmer to the swim band, the swimmer would be restrained in an unbalanced way that would greatly detract from the effective use and enjoyment of Burke's swim band.

Further manufacturing difficulty and expense is required by a Burke swim band at the buckle and the anchor strap due to the variety of materials demanded by the Burke design.

It can readily be seen that there is a need for a stationary swimming device that potentially entangles the swimmer to the least possible extent, that allows the engagement by the swimmer in the greatest number of swimming strokes, that allows the point of attachment to the swimmer to be adjusted to the greatest possible extent, that minimizes the risk imposed by misplaced parts, and that can be manufactured in an inexpensive way that requires a minimum of different materials.

SUMMARY OF THE INVENTION

The present invention resides in a stationary swimming device that is easy to use effectively with any swimming stroke and that is readily manufactured using a limited number of easily obtained materials.

VELCRO hook and loop fasteners provide means of attachment to a stationary poolside object and to the ankles of the swimmer. Nylon straps are securely connected to the VELCRO fasteners and provide loops through which a Bungee cord can be passed so that the VELCRO fasteners are securely attached to the Bungee cord. A significant length of Bungee cord separates the base strap from the ankle straps so that the swimmer may put some distance between himself and the base. Neoprene rubber or the like cushions the attachment between the swimmer and the ankle straps and reduces any friction therebetween.

By attaching the base strap to a stationary poolside object and by attaching the ankle straps to himself, the swimmer can inexpensively and easily engage in the beneficial, low-impact sport of continuous exercise swimming without requiring a large, private pool facility or a small, counter-current pool.

OBJECTS OF THE INVENTION

It is an object of this invention to provide means by which a swimmer can engage in continuous swimming.

It is an object of this invention to provide means by which a swimmer can engage continuously in any of several swimming strokes.

It is an object of this invention to provide means by which a swimmer can engage in continuous swimming by holding the swimmer stationary in the water.

It is an object of this invention to provide stationary swimming means that are adjustable.

It is an object of this invention to provide stationary swimming means that enable the swimmer to engage in any of several swimming strokes with the least encumbrance or entanglement.

It is an object of this invention to provide stationary swimming means that are manufactured easily and inexpensively.

It is an object of this invention to provide stationary swimming means that are not rendered useless by misplacing or losing a part or component by providing an integral device.

These and other objects and advantages of the present invention will be apparent from a review of the following specification and accompanying drawings.

BRIEF DESCRIPTION OF THE DRAWINGS

FIG. 3 is a plan view of the ankle strap of the present invention, showing its attachment to the elastic cord.

FIG. 4 is a cross-sectional view of the ankle strap of FIG. 3 taken generally along line 4—4.

FIG. 5 is a cross-sectional view of the securement means for the elastic cord shown in FIG. 3 taken generally along line 5—5.

FIG. 6 is a plan view of the interior of the ankle strap of FIG. 3.

FIG. 7 is a plan view of the exterior of the ankle strap of FIG. 3.

DESCRIPTION OF THE PREFERRED EMBODIMENT(S)

Figure 1:
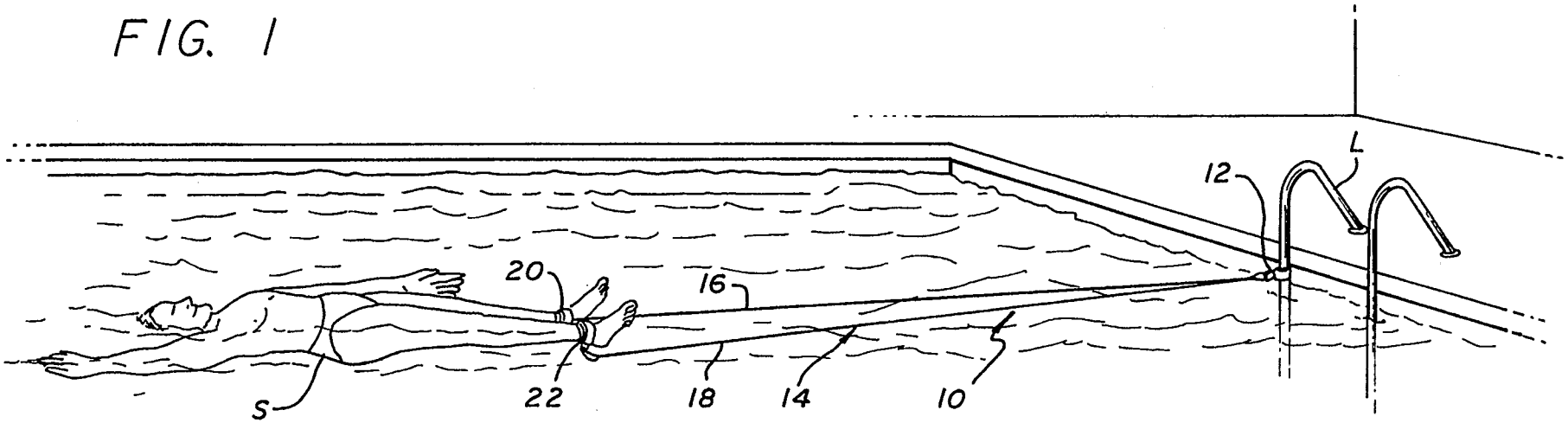
FIG. 1 is a perspective view of a swimmer performing the backstroke using the stationary swimming device of the present invention.

Referring to FIGS. 2–7, the stationary swimming device 10 of the present invention has a base strap 12, an elastic cord 14 having two extensions thereof 16, 18 and two ankle straps 20, 22 The base strap 12 is similar in construction to the two ankle straps 20, 22 and the ankle straps 20, 22 are both similar in construction to each other. A description of the construction of one ankle strap 20 well describes the construction of the other ankle strap 22 and the base strap 12. One difference between the construction of the ankle straps 20, 22 and the base strap 12 that cushioning or padding is not necessary for the base strap 12.

As shown in FIGS. 3–7, the ankle strap 20 is layered. The inner layer is neoprene rubber 30 or other cushioning material. The neoprene layer 30 protects the swimmer's ankle from the other layers of the ankle strap 20, these other layers being durable and strong. The neoprene layer 30 is sewn or otherwise attached to one of two strips 32, 34 of hook and loop fastener, such as that marketed under the name VELCRO. Preferably, the neoprene layer 30 is sewn to the back side of loop portion 32 of the fastener, with the hook portion 34 forming the other half of the ankle strap 20.

The two portions 32, 34 of the hook and loop fastener are approximately two inches wide with the loop portion 32 approximately seven and one-half inches long and the hook portion 34 approximately six inches long. The neoprene layer 30 is approximately nine and one-half inches long. The loop portion 30 of the hook and loop fastener runs the length of the neoprene layer 30, with the excess portion of the neoprene layer 30 serving to provide some overlap to protect the swimmer's ankle.

At the end of the hook portion 34 is a detachment loop 36. The detachment loop 36 is a short length of strong material that is sewn to the end of the hook portion 34. When the ankle strap 20 is attached to the swimmer S, the detachment loop 36 is readily available and accessible by the swimmer S so that the ankle strap 20 may be easily and quickly detached from the swimmer S.

The hook portion 34 and the loop portion 32 of the hook and loop fastener are connected to one another by a strap of material 38, preferably Cordura nylon. One end of the strap 38 travels between the neoprene layer 30 and the loop portion layer 32 approximately three and one-half inches and is sewn or otherwise attached to the other layers. The other end of the strap 38 travels along the exterior of the hook portion 34 of the hook and loop fastener approximately one inch and is sewn or otherwise securely attached to the hook portion 34. Both the loop portion 32 and the hook portion 34 extend out and further from the end of the strap 38. The strap 38 is approximately eleven inches long and provides structural integrity to the ankle strap 20.

Approximately six and one-half inches of strap 38 material lies between the closest connection of the strap 38 with the hook portion 34 and the loop portion 32. Adjacent to the loop portion 32, a loop 40 of strap 38 material is formed by sewing the strap 38 to itself. The loop 40 is approximately one and one-half inches long. The loop 40 is formed by the sewn seam 42 that serves to hold in place a loop 44 formed from the elastic cord 16. The excess portion of neoprene material from the neoprene layer 30 is increased near the seam 42 and extends along the hook portion side of the strap 38 approximately one inch to provide a protecting overlap of neoprene material for the swimmer's ankle.

The ankle strap loop 40 entraps a corresponding loop 44 formed from the elastic cord 16. The cord loop 44 is approximately five and one-half inches long. The end 46 of the cord 16 is tightly held against another portion 48 of the cord 16 to form the cord loop 44. The cord end 46 is held tightly against the other cord portion 48 by means of one or more clips 50 or other means that force and maintain the cord end 46 against the other cord portion 48. In the art, such clips 50 may be known as "hog clips" and are short pieces of metal that are bent into a tight circle by a pair of special pliers. The entire structure of the cord and clips are enshrouded by shrink wrap 52 to protect the cord 16 and the clips 50. The junction 54 so formed provides a secure means by which the elastic cord 16 and the ankle strap 20 may be attached to one another.

Figure 2:
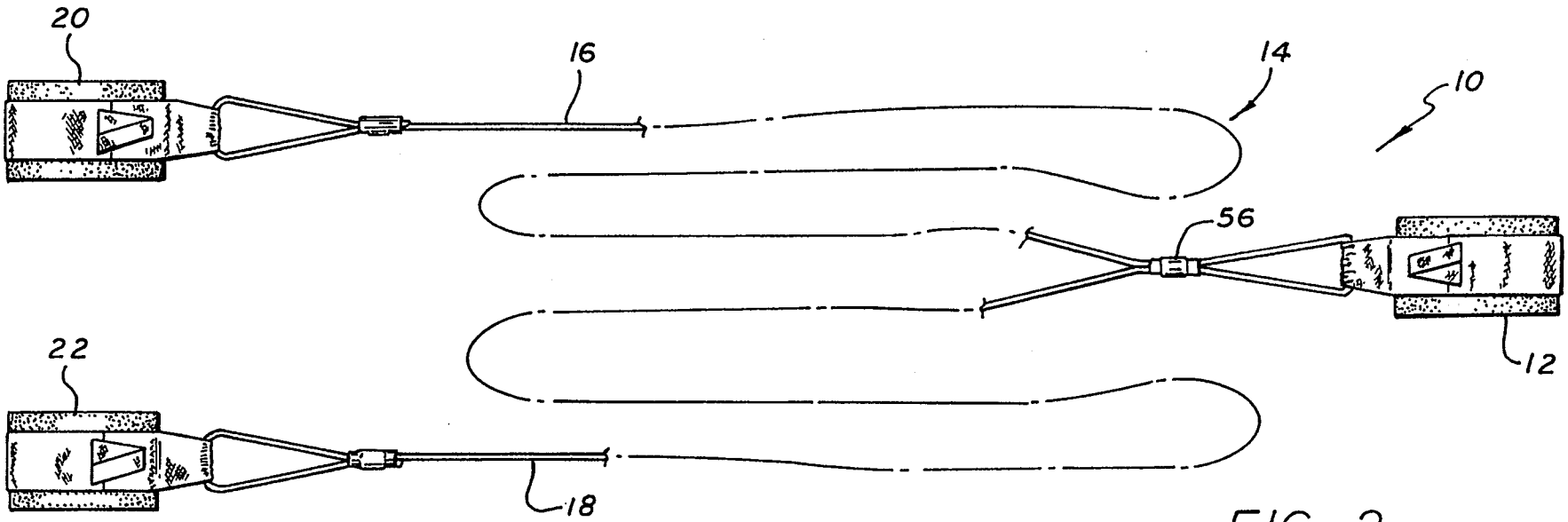
FIG. 2 is a plan view of the present invention.

Each Bungee cord extension 16, 18 is approximately six feet long. The two cord extensions 16, 18 may be individual cords, or may be the ends of a centrally fixed single elastic cord. Preferably, the cord extensions 16, 18 are the ends of a single elastic cord that is centrally attached to the base strap 12 by means similar to that used to attach the cord 16 to the ankle strap 20. As is shown in FIG. 2, the cord 14 is fixed at a central cord junction 56. The base strap 12 is similar in construction to the ankle strap 20 save that the neoprene layer 30 used in the ankle strap 20 need not be present.

To use the stationary swimming apparatus of the present invention, the swimmer attaches the base strap 12 to a stationary poolside object such as a pool ladder L as shown in FIG. 1. The ankle straps 20, 22 are then attached to the swimmer's ankles in a snug fashion, The strap loops 40 are typically best situated so that they extend out and away from the swimmer S. When swimming then, the swimmer's feet may come together more closely without interference from the strap loops 40. For the breast stroke, the swimmer may find it more advantageous to locate the strap loops 40 towards the inside of the ankle. For any swimming stroke, the swimmer is enabled by the single attachment of the cord extensions 16, 18 to their respective ankle straps 20, 22 to adjust the point of attachment where the cord extensions 16, 18 attach to the swimmer S anywhere around the swimmer's ankle.

The cord extensions 16, 18 should not be entangled with one another or another object and have the tendency to remain unencumbered once clear of all entanglements. When the swimmer begins to swim, the slack is removed from the cord extensions 16, 18 and the swimmer stretches the elastic cord 14 by swimming until the restraining force of the stationary swimming device balances the forward force of the swimmer in the water. Due to the elastic nature of the cord 14, the paddling movements of the swimmer's feet are not greatly hindered.

The detachment loop 36 present on the ankle strap 20 provides a significant advantage and increases the margin of safety in the stationary swimming device 10 of the present invention. Whenever people are around water, there is always the chance that tragedy may strike and injury occur. The greatest danger is of drowning. The stationary swimming device 10 of the present invention is designed to restrict the motion of the swimmer relative to the device 10. As the swimmer's motion is restricted, circumstances may arise where it is important, or even crucial, for the swimmer to free him or herself from the stationary swimming device 10.

Typical hook and loop fasteners are intended to fit closely and tightly with each other's counterpart. While this creates an effective means for securing the two portions of the hook and loop fastener to one another, it provides certain difficulties when the two portions of the hook and loop fastener should be disengaged. These certain difficulties are heightened and increased when circumstances are strained and the stress of the moment requires quick and effective action.

Beyond the tightness of the hook and loop fastener when the two corresponding portions are engaged, it is sometimes difficult to find an edge where either the hook portion or the loop portion may be grasped so that it may be disengaged from its counterpart. The snug fit by which the two portions engage themselves serve to prevent quick and easy disengagement.

In order to quickly and easily disengage the hook and loop portions 32, 34 of the ankle strap 20, the detachment loop 36 is provided so that not only can a convenient "edge" be found so that the hook portion 34 can be pulled away from the loop portion 32, but also to provide leverage against the adhesion between the hook portion 34 and the loop portion 32 and to provide an easily graspable means for doing so. The detachment loop 36 is one of only two extensions present on the exterior of the ankle strap 20. The other extension is the strap loop 40with the connected elastic cord extension 16.

Should an emergency or urgent situation arrive such that it is imperative that the swimmer disengage from the stationary swimming device 10, the swimmer can do so easily as the swimmer will know the location of the strap loop 40 and cord extension 16 by feel. The detachment loop 36 can easily be found by the swimmer S by reaching for his ankle. No harnesses are present to entangle or impede the disengagement and only a quick, strong yank on the detachment loop 36 is necessary to free the swimmer's ankle from the ankle strap 20.

In the water, the design of the present invention provides significant advantages. There are no detachable parts to be lost or misplaced. The present device can be adjustably attached to the swimmer's ankle to provide the best or most comfortable fit. The present device can be easily stored, easily manufactured, and easily used with a minimum of inconvenience. With the added safety of the detachment loops 36, the stationary swimming device 10 of the present invention provides excellent means to achieve the beneficial exercise of continuous swimming in readily available pools.

While the present invention has been described with regards to particular embodiments, it is recognized that additional variations of the present invention may be devised without departing from the inventive concept.

What I claim is:

1. A stationary swimming apparatus comprising:

first and second ankle straps, each of said first and second ankle straps including:

an elongated flexible ankle strap element having a substantially uniform width, said ankle strap element including a first end portion, a central portion and a second end portion, said central portion being longitudinally folded and secured to itself along a transverse seam so as to define an attachment loop;

a first elongated flexible fastening strap element having an associated width generally equal to the width of said ankle strap element, said first fastening strap element including first and second ends with the first end thereof overlying and being fixedly secured to the first end portion of said ankle strap element and the second end thereof extending longitudinally away from said ankle strap element, said first fastening strap element carrying a plurality of hook-type fastening elements that project from one side thereof;

a second elongated flexible fastening strap element having an associated width generally equal to the width of said ankle strap element, said second fastening strap element including a first end fixedly secured to and entirely overlying the second end portion of said ankle strap element and a second end that extends longitudinally away from said ankle strap element, said second fastening strap element carrying a plurality of loop-type fastening elements that project from one side thereof; and an elongated cushioning element having an associated width that is greater than the width associated with said second fastening strap element, said cushioning element being positioned along a side of said second fastening strap element opposite the side of said second fastening strap element that carries said plurality of loop-type fastening elements, said cushioning element being securely attached to said second fastening strap element with the second end portion of said ankle strap element sandwiched therebetween, said cushioning element including first and second ends that extend longitudinally beyond the first and second ends of said second fastening strap element respectively;

an elastic cord having a first end portion, a central portion and a second end portion, each of said first and second end portions of said elastic cord defining loop that is interengaged with the attachment loop formed in a respective one of said ankle strap elements; and releasably attachable base strap means to which the central portion of said elastic cord is attached, said base strap means being selectively, releasably attachable to a fixed poolside structure such that, when the stationary swimming apparatus is used in a pool with each of said first and second ankle straps being wrapped about a respective ankle of a user and secured by interengaging the plurality of hook-type fastening elements of said first fastening strap element with the plurality of loop-type fastening elements of said second fastening strap element and said base strap means is releasably attached to a poolside object, the user can practice various swimming strokes without traveling through the water.

2. Stationary swimming apparatus of claim 1, and in which said releasably attachable base strap means includes hook and loop-type fastener means and is comprised by an elongated flexible base strap element having a first end and a second end;

an elongated flexible base strap hook element comprising a first element of said base strap hook and loop-type fastener means and having a width selected so as to be generally coextensive with the width of said base strap element and of a preselected length, said base strap hook element having a first end and a second end;

means for fixing said base strap hook element first end to said base strap element so as to overlie and extend beyond said first end thereof and be in longitudinal alignment with said base strap element so as to extend away from said base strap element second end;

an elongated flexible base strap loop element comprising a second element of said base strap hook and loop-type fastener means and having a width selected so as to be generally coextensive with the width of the base strap hook element and of a preselected length, said base strap loop element having a first end and a second end;

means for fixing said base strap loop element second end to said base strap element so as to overlie and extend beyond said second end thereof and be in longitudinal alignment therewith so as to extend away from said base strap element first end; and base strap loop means formed on the base strap element between the first end and the second end thereof so as to form a loop which extends transversely across the width of the base strap element and engages a loop formed in the elastic cord intermediate the ends thereof to attach the base strap to the elastic cord.

3. The stationary swimming apparatus of claim 2, and in which a selected one of said ankle strap hook element and said ankle strap loop element for each of said first and second ankle strap means has a detachment loop fixed thereto so as to extend longitudinally away from the end thereof which is not attached to the ankle strap element.

4. The stationary swimming apparatus of claim 1, and in which a selected one of said ankle strap hook element and said ankle strap loop element for each of said first and second ankle strap means has a detachment loop fixed thereto so as to extend longitudinally away from the end thereof which is not attached to the ankle strap element.

* * * * *